US007877966B2

(12) United States Patent
Knoke et al.

(10) Patent No.: US 7,877,966 B2
(45) Date of Patent: Feb. 1, 2011

(54) MACHINE FOR FORMING, FILLING AND CLOSING BAGS WITH A BAG LIFTING DEVICE

(75) Inventors: Thomas Knoke, Bielefeld (DE); Uwe Koehn, Osnabrueck (DE); Ruediger Grosse-Heitmeyer, Westerkappeln (DE); Thomas Hawighorst, Osnabrueck (DE)

(73) Assignee: Windmoeller & Hoelscher KG, Lengerich (DE)

( * ) Notice: Subject to any disclaimer, the term of this patent is extended or adjusted under 35 U.S.C. 154(b) by 0 days.

(21) Appl. No.: 11/667,556

(22) PCT Filed: Oct. 24, 2005

(86) PCT No.: PCT/EP2005/011418

§ 371 (c)(1),
(2), (4) Date: May 11, 2007

(87) PCT Pub. No.: WO2006/053627

PCT Pub. Date: May 26, 2006

(65) Prior Publication Data

US 2007/0294982 A1 Dec. 27, 2007

(30) Foreign Application Priority Data

Nov. 11, 2004 (DE) ..... 10 2004 054 621
Aug. 11, 2005 (DE) ..... 10 2005 037 916

(51) Int. Cl.
*B65B 1/04* (2006.01)

(52) U.S. Cl. ..... 53/469; 53/451; 53/459

(58) Field of Classification Search ..... 53/451, 53/459, 502, 442, 242, 249, 551, 564, 567, 53/570, 467–469; 141/148, 150, 172, 110, 141/113, 260, 263
See application file for complete search history.

(56) References Cited

U.S. PATENT DOCUMENTS 3,269,079 A * 8/1966 Schmied ..... 53/426
3,531,908 A * 10/1970 Tuma et al. ..... 53/426
3,911,642 A * 10/1975 Ernstsson et al. ..... 53/426
4,074,507 A * 2/1978 Ruf et al. ..... 53/502
4,185,669 A * 1/1980 Jevakohoff ..... 141/59
4,747,253 A * 5/1988 Schulte ..... 53/433

(Continued)

FOREIGN PATENT DOCUMENTS

DE 9301355 1/1994

*Primary Examiner*—Hemant M Desai
(74) *Attorney, Agent, or Firm*—Jacobson Holman PLLC

(57) ABSTRACT

A machine for forming, filling, and sealing sacks has an unwinding device for a plastic tube, a cross-cutting device that cuts the tube perpendicularly to its principal axis of symmetry and creates tubular pieces in the process, a bottom forming means for forming a sack bottom at one end of the tubular piece, transport equipment to transport the resulting sacks through the machine, a filling station with a feeding element for filling the product in the sack, means of reducing the distance between the product discharge opening of the feed element and the bottom of the sack to be filled, and sealing means to seal the filled sack. The means of reducing the distance is a sack lifting device with which the sack can be lifted in the filling station such that an upper edge of the sack is located above the product discharge opening of the feed element.

20 Claims, 2 Drawing Sheets

U.S. PATENT DOCUMENTS 4,809,485 A * 3/1989 Nielsen ..... 53/503
4,922,650 A * 5/1990 Akao et al. ..... 47/1.1
4,976,091 A * 12/1990 Salemka et al. ..... 53/467
5,014,493 A * 5/1991 West ..... 53/410
5,443,102 A * 8/1995 Svendsen ..... 141/10
5,581,984 A * 12/1996 Domke et al. ..... 53/552
5,787,687 A * 8/1998 Mueller et al. ..... 53/473
2004/0182469 A1 * 9/2004 Concetti ..... 141/10

* cited by examiner

MACHINE FOR FORMING, FILLING AND CLOSING BAGS WITH A BAG LIFTING DEVICE

CROSS-REFERENCE TO RELATED APPLICATION

This is a national stage of PCT/EP05/011418 filed Oct. 24, 2005 and published in German.

BACKGROUND OF THE INVENTION

1. Field of Invention

The invention is related to a process of manufacturing, filling and closing plastic sacks with dust-like or even granular products as well as of sealing the filled sacks.

2. Description of the Prior Art

Such a device is, for example, known from DE 93 01 355 U. A device for manufacturing, filling and sealing sacks open on one side and preferably provided with side folds made of thermo plastic material is already described here, in which a first welding and cutting station for forming the sack with bottom weld and a second welding station for sealing the sack are available. The filling machines are generally arranged in the FFS (Form, Fill and Seal) category.

While filling dust-like products in machines of the mentioned category through the force of gravity or through free fall, it should be possible to remove the dusty air raised by the falling product from the sack. Removing the air often leads to contaminations in the upper border area of the sack. Conditioned by the contamination with product dust, the sack cannot be sealed securely with the help of the welding that is generally customary in this type of packaging. Moreover, the dust has an adverse effect on the environment and must be removed separately.

Further, filling dusty products according to the described known filling process normally leads to a conspicuously increased product volume or to a clear reduction of the bulk weight, because the product absorbs a lot of air during the free fall. This in turn leads to the condition that considerably more packaging material is used up to fill the product. Moreover, the air must again be removed from the sack, as otherwise it would not be possible to stack or store the sacks.

As the process or air removal is normally very time-consuming, air discharge cannot be undertaken before the sack is sealed. The sack must therefore have a perforation. This has an additional negative influence on the environment, because the fine-grained, dusty products can leak into the atmosphere partially through the perforation in the packaging.

With the passage of time, the volume of the bulk product decreases again. The sack packaging measured on the basis of the packaged bulk volume is conspicuously large. Such filled sacks are very difficult to stack on pallets because they are not stable.

EP 1 459 981 A1 therefore recommends the introduction of the filling branches of a feed element of an FFS machine in the opening of a sack. However, such a device is very expensive from the design perspective.

SUMMARY OF THE INVENTION

The task of the present invention is to recommend the design of a simpler device that can reduce the dust or dust formation through a filler.

The problem is solved by the features of the invention described herein.

The following remark must be made on the generic name of the main claim: Normally, an unwinding device of an FFS machine unwinds a plastic tube made of a thermoplastic material, which is characterized as tube with side folds. The cross cutting direction that cuts the tube perpendicularly to its principal axis of symmetry and creates tubular pieces often also forms the sack bottom from the sacks resulting from the tubular pieces through a cross cutting seam welding. In the FFS sector however, cross cutting with a knife coupled with cross welding is more useful. The sacks resulting from the cutting and bottom formation are transported through the machine suitably with the help of transportation devices. The transportation devices are normally grippers. The sack is filled in a filling station. In this context, it is typical for the feed element for filling the sack with the product to consist of a fall tube and a screw conveyor. The force of gravity (free fall) or the effect of excess pressure can also be exploited for this purpose. Currently, only one sack is filled in such filling stations at a time; the associated FFS machines normally include only one filling tube and one conveyor belt per filling station, as well as other device characteristics that enable the sack to be filled. This includes e.g., a hopper or funnel.

The patent EP 1 459 981 A1 mentioned above recommends that dust formation can be reduced to the minimum by reducing the distance between the product discharge opening and the bottom of the sack to be filled in the filling station or before the filling. To this end, the mentioned patent recommends the introduction of filling branches in the sack in the vertical direction. In FFS machines the sack is normally sealed immediately after the filling operation through cross welding. The present invention reduces the distance between the product discharge opening and the bottom of the sack to be filled by lifting the sack in the filling station, i.e., directly before starting the filling operation. Thus, other height changes during the transportation of the sacks or the sack foil units are not included in the purview of the present invention. Normally, the lift that the sack is subjected to in the filling station is considerable. It could be more than half the length of the sack. To minimize dust formation, it would be desirable that the product falls from low heights on to the sack bottom. The unavoidable falling height at the start of the filling operation can be reduced by less than 20 cm. The lifting movement of the sack must be predominantly vertical, and the sack is drawn over the usually cylinder-shaped falling tube. The feed element can remain permanently fixed, i.e., should not be procured for executing longer vertical movements in particular. As already mentioned, such a feed element covers only a fall tube and a conveyor worm as well as other objects like a hopper. A sack bottom supporting device is especially advantageous to the further development of the device according to the invention, because support for the just welded bottom may be necessary even while filling the sack from relatively low heights. In this context, the sack bottom supporting device can include moveable supporting surfaces in the form of lifting platforms. Such supporting surfaces can be moved along with the overall lifting movement of the sack. Another option of providing sack bottom supporting devices which is simple from the design perspective, is to have swiveling supporting surfaces that can e.g., be folded away along a horizontal axis when the sack is lowered again after the filling operation. In a further variant of FFS machines, and here especially of the present invention, it is advantageous to provide a connector fitting which clamps around at least parts of the feed element or its cylinder-shaped fall tube and which can be moved into the intermediate space between the feed element and the sack wall during the filling operation. This movement can take place along the fall tube of the feed element. The connector fittings can also be designed in such a way that it contains blowing elements along its outer side that seal the intermediate space between the sack wall and the filling branch. The same can also apply to its inner wall, though here the intermediate space between the support fitting itself and the feed element would have to be sealed. This way it would be possible to seal the sack from the outer atmosphere during the filling operation, as only the fall tube would reach into the sack. An advantageous suction operation at the feed element in the FFS process does not only discharge air from the product—as described further below. It also leads to an air inflow from the exterior, so that the result is a directed flow. It is also advantageous if the air is drawn between the connector fittings and sack wall in connection with the connector fittings. In particular, this enables the sack wall sections to be kept free of the filling material especially at the height of the connector fitting. The overall measures to keep the sack wall free of filling material is important, if this material is used to close the sack through a sealing operation. In FFS machines, a continuous determination of the sack weight is undertaken during the filling operation. In the device at hand, such a monitoring of the sack weight is to be undertaken preferably through a sack weight measurement at the sack lifting device or the sack bottom supporting device. These two elements of the machine can also be equipped with means of generating vibrations. These are used in FFS machines to reduce the air proportion in the filling material further. During the filling operation, it is in general advantageous in the FFS process if the product discharge opening of the feed element is below the filling level of the sack. This can be managed rather well with a device according to the invention. Material and filling speed-specific target values must be observed while regulating the distance between the product discharge opening of the feed element and the filling level to minimize mist formation in the product. It is apparently advantageous to provide a control device to which the different physical values suitable for determining the filling level of the sack are communicated. The current weight of the sack can naturally be one of the mentioned values. However, the filling level of the sack can also be calculated from the volume flow of the filling material. Other processes could then determine the filling level of the sacks with suitable rays. The control device can then undertake a continuous lowering of the position as a function of the sack level to be determined, so that the product discharge opening of the feed operation is always a target distance below the filling level of the sack during the entire filling operation. In case of other filling materials however, the product discharge opening can also be above the filling level. This can be achieved with the help of the same measures/device characteristics. Another simple option of maintaining such a target distance is to lower the sack as a function of time.

Other details and design models of the present invention can be taken from the sub-claims and the object descriptions.

DETAILED DESCRIPTION OF THE PREFERRED EMBODIMENTS

Figure 1:
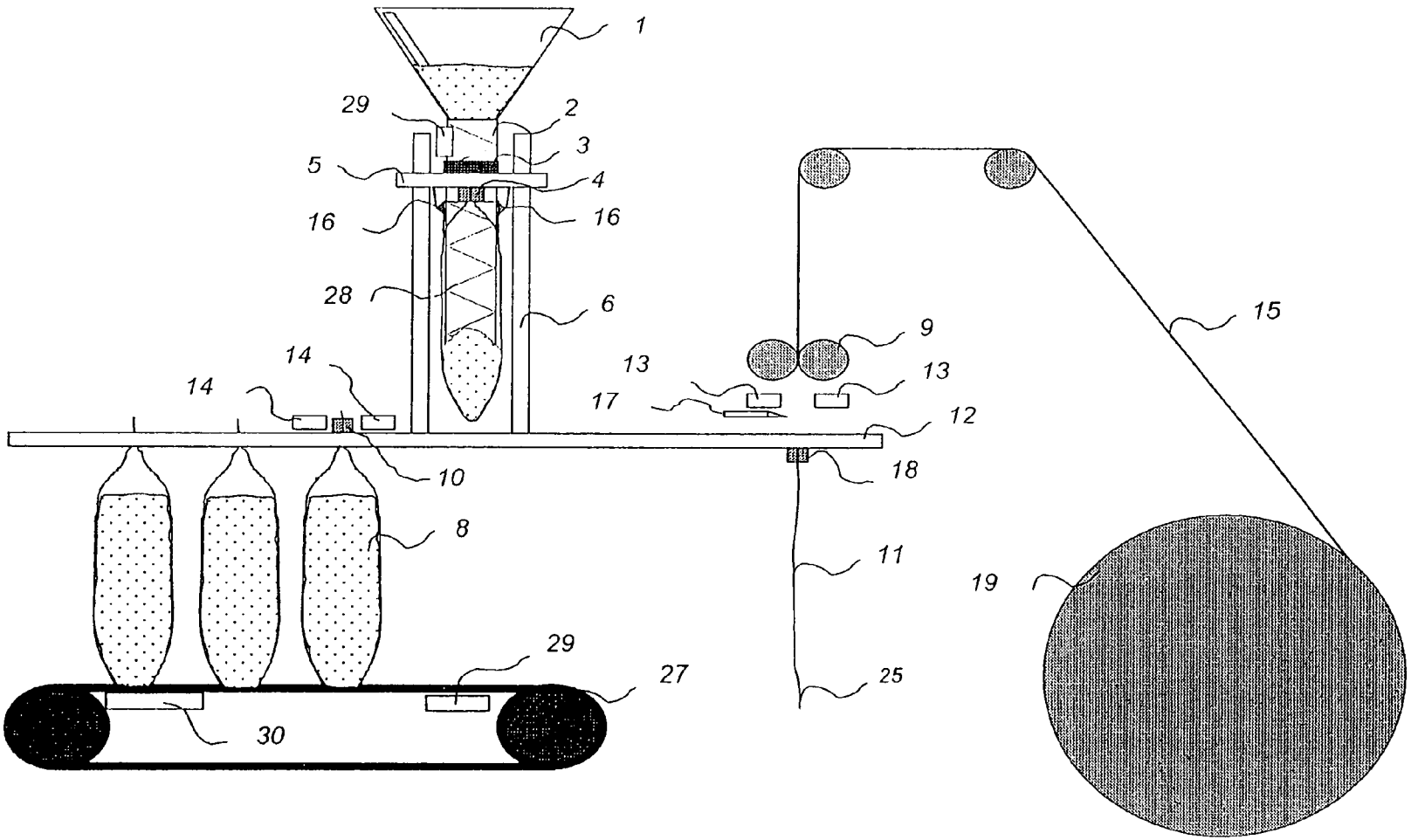
FIG. 1 is a schematic illustration of a machine for forming, filling, and sealing sacks in accordance with the present invention.
Figure 3:
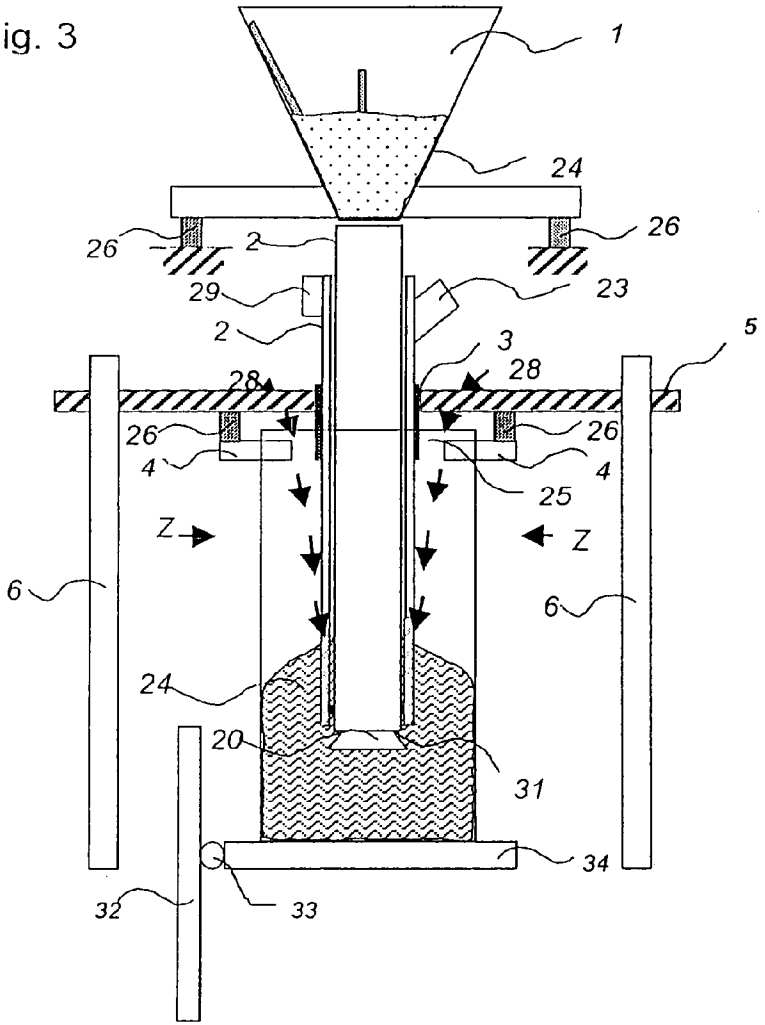
FIG. 3 is an enlarged view of another embodiment of the machine shown in FIG. 1 and shows the step of filling a sack.
Figure 2:
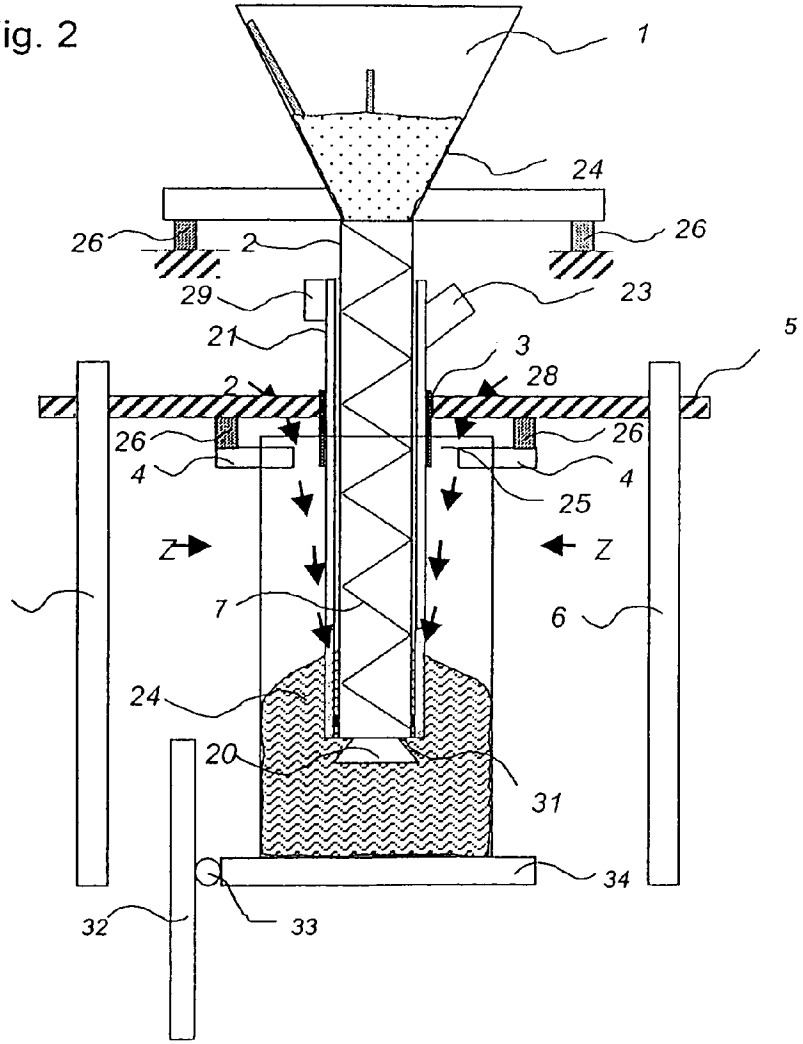
FIG. 2 is an enlarged view of the machine shown in FIG. 1 and shows the step of filling a sack.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

A tube foil web 15, preferably with inserted side fold, is first conveyed into a horizontally moving transport means 9, e.g. a gripper pair 18, by virtue of a roller system.

The foil web 15 is cut by a knife 17 after the section corresponding to the desired sack length is drawn. The bottom welding 13 takes place simultaneously. The empty sack 11 sealed at the lower end is transferred to a horizontally moving transport means, e.g., a gripper 18 and transported to the filling station.

Here, another transport means 4 consisting of 3, 4, 5 takes over the sack section. The empty sack is now opened with the help of a suction system 16. For this, Gripper 4 is moved in the Z direction. The connector fitting of the transport system 3 is moved in the sack and it protects the inner surface of the sack from pollution due to possible product deposits on the feed pipe 2, 21.

The opened sack is drawn by the transport system 3, 4, 5 through the feed tube 2, 21, 22 till the lower end of the sack is approximately at the height of the product discharge opening 31. The sack bottom supporting device 32, 33, 34 is driven under the sack bottom. The sealing tube 21 is lifted and it releases the product discharge opening 31. The product/bulk product 24 is filled in the sack. During this time the transport system 3, 4, 5 lowers the sack in such a way that the product discharge opening 31 is always below the filled level. Before the end of the product/bulk product 24 feed operation, the product discharge opening 31 must be above the filling level at least once. At the end of the filling, the sealing tube 21 is lowered and it seals the product discharge opening 31. The connector fittings are withdrawn from the sack. The gripper 4 of the transport system 3, 4, 5 is now moved against the Z direction and it pulls the opening area to the upper edge 25 of the earlier opened sack. Another transport means 18 takes over the filled sack 8. The upper edge of the sack 25 is now sealed with the help of the welding device 14. If necessary, the filter 22 integrated in the sealing tube 21 can be used along with the feed operation. The required vacuum is guided through the branch 23. The integration of the filter 22 in the sealing tube allows a very complicated structure that enables the filling of even relatively small sacks. The suction of air leads to a certain extent to a compaction of the bulk product. Thus, a sack size suitable for the product quantity can be selected this way.

This effect of product compacting can be enhanced further through the additional use of vibration generators/beaters 29. Here it is advantageous to vibrate the feed pipe 2, 21, 22 with the help of a vibration generator 29, because at least during the filling operation, at least some parts of its surface are located inside the product. The vibrations are transferred from the feed tube 2, 21, 22 to the product 24, resulting in a compaction. Another advantage of the vibrating feed tube 2, 21, 22 is that the formation of product deposits on the feed tube 2, 21, 22 can be avoided to a large extent in this way. The vibrator 29 could also be arranged on the "sack bottom support device" 34.

Another function of the exhaust can be to specify a corresponding flow direction 28 to keep the "mist" (product dust) occurring in case of particularly light and dusty products away from the inner surface of the sacks in the area of the subsequently welded seams. For this one must ensure that the air can enter at the periphery of the connector fittings or between the connector fittings and the feed element.

A particularly advantageous design model of the carriage is to mount the frame 5 including the supports 3, transportation means 4 as well as the suction device 16 on sensors. The sensors send their signal to an electronic weighing machine which eventually controls the feed operation.

Another option of product weighing that is advantageous to the overall FFS sector is to mount the entire feed element consisting of 1, 2, 21 on sensors 29. The product feed above feed device 1 would then fill an exact amount of the product 24 in the feed device 1 mounted on the sensors. The duration of the feed is monitored by an electronic system connected to the sensors. The earlier weighed product quantity can now be conveyed to the sack through the feed element at high speed.

It is advantageous in particular to combine the two methods. This way it can be ensured that the previously weighed product quantity is fully conveyed into the sack. It is also possible to think in terms of basing the previously weighed product quantity on the actual weight of the sack measured later.

A purely volume-based feed calculated on the basis of the bulk weight of the product as well as the theoretically conveyed volumes, e.g., of a screw conveyor, is also conceivable. In this case it would be particularly advantageous to regulate the feed time through a subsequently activated weighing system, e.g. a belt control weighing machine.

In case of direct feed into the sack, the feed system can preferably consist of a vertically arranged screw conveyor.

In case of advance weighing, the bulk product can also by conveyed to the sack with the help of a pressure system. For this, the bulk product level in feed device 1 is subjected to an overpressure. The process presumes below the level filling on account of the required counter pressure. The air brought in by the bulk product can be discharged through a filter 22 integrated in the closure tube.

Another design model would be to permit filling by virtue of the force of gravity or free fall in case of flowing bulk products with weak dust formation.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of reference signs | |
|---|---|
| 1 | Funnel |
| 2 | Feed element |
| 3 | Connecting fittings |
| 4 | Transportation means |
| 5 | Frame |
| 6 | Guidance |
| 7 | Worm |
| 8 | Filling sack |
| 9 | Drawing rollers |
| 10 | Transportation means |

-continued

| List of reference signs | |
|---|---|
| 11 | Empty sack |
| 12 | Guidance |
| 13 | Bottom welding |
| 14 | Seam welding |
| 15 | Tube foil web |
| 16 | Suction unit |
| 17 | Knife |
| 18 | Transportation means |
| 19 | Unwinding device |
| 20 | Sealing |
| 21 | Sealing tube with filter |
| 22 | Filters |
| 23 | Supports |
| 24 | Product |
| 25 | Upper edge of sack |
| 26 | Sensors |
| 27 | Transportation belt |
| 28 | Directed flow |
| 29 | Vibration generator |
| 30 | Control balance |
| 31 | Product discharge opening |
| 32 | Guidance |
| 33 | Joint |
| 34 | Sack bottom support |

What is claimed is:

1. A machine for forming, filling, and sealing sacks, comprising:

an unwinding device for a plastic tube;

a cross cutting device that cuts the tube perpendicular to a principal axis of symmetry thereof to create tubular pieces;

a bottom forming device for forming a sack bottom at one end of the tubular piece;

transportation devices for conveying the resulting sacks through the machine;

a filling station with a feed element for filling the sacks with a product;

a device to reduce a distance between a product discharge opening of the feed element and the bottom of the sack to be filled, the distance-reducing device including a sack lifting device configured to lift the sack in the filling station such that a top edge of the sack is located above the product discharge opening of the feed element;

a device to seal the filled sack; and a control device that (i) is connected to measuring instruments that transfer to the control device information used to determine a filling level of the sack and (ii) regulates the distance between the product discharge opening and the filling level of the sack based on material- and filling-specific target values that minimize mist formation in the product, the discharge opening of the feed element being below the fill level of the product in the sack.

2. The machine according to claim 1, wherein the control device guides the sack lifting device such that the sack lifting device is lowered slowly as the sacks are filled.

3. The machine according to claim 1, wherein the control device guides the sack lifting device as a function of time such that the sack lifting device lowers the sack slowly as the sack is filled.

4. The machine according to claim 1, wherein the sack lifting device is configured to lift the sack by half of a length of the sack.

5. The machine according to claim 1, wherein the sack lifting device is configured to lift the sack by two-thirds of a length of the sack.

6. The machine according to claim 1, wherein the sack lifting device is vertically movable along the transportation device of the product at the time of the filling.

7. The machine according to claim 1, wherein the feed element is fixed.

8. The machine according to claim 1, wherein the feed element includes a drop tube and a worm conveyor.

9. The machine according to claim 1, further comprising a sack bottom supporting device that supports the bottom of the sack at least during a part of the filling operation.

10. The machine according to claim 9, wherein the sack bottom supporting device includes vertically moveable supporting surfaces.

11. The machine according to claim 9, wherein the sack bottom supporting device includes a supporting area that can be swiveled.

12. The machine according to claim 1, further comprising a connecting fitting which grips at least parts of the feed element and which is positionable between the feed element and an inner wall of the sack.

13. The machine according to claim 12, wherein the connecting fitting is movable along the feed element.

14. The machine according to claim 9, wherein at least one of the sack lifting device and the sack bottom supporting device is configured to determine a weight of the sack.

15. The machine according to claim 9, wherein at least one of the sack lifting device, the sack bottom supporting device, and the feed tube is connected to an active device configured to generate vibrations.

16. A process of forming, filling, and sealing sacks, comprising:

unwinding a plastic tube;

cross cutting of the tube perpendicular to a principal axis of symmetry thereof to produce tubular pieces;

forming a sack bottom at one end of the tubular piece;

transporting the formed sack;

reducing a distance between a product discharge opening of a product feed element and a bottom of the sack to be filled by lifting the sack, the distance-reducing step including (i) transferring to a control device information used to determine a filling level of the sack during a sack filling operation and (ii) regulating the distance between the product discharge opening and the filling level of the sack to maintain the product discharge opening at a target level below the filling level of the sack;

filling the sack with the product through the feed element; and sealing the filled sack.

17. The process according to claim 16, wherein the control device determines the filling level of the sack from a momentary weight of the sack.

18. The process according to claim 16, wherein the control device determines the filling level of the sack from a volume flow of the product.

19. A machine for forming, filling, and sealing sacks, comprising:

an unwinding device for a plastic tube;

a cross cutting device that cuts the tube perpendicular to a principal axis of symmetry thereof to create tubular pieces;

a bottom forming device for forming a sack bottom at one end of the tubular piece;

transportation devices for conveying the resulting sacks through the machine;

a filling station with a feed element for filling the sacks with a product;

a device to reduce a distance between a product discharge opening of the feed element and the bottom of the sack to be filled, the distance-reducing device including a sack lifting device configured to lift the sack in the filling station such that a top edge of the sack is located above the product discharge opening of the feed element;

a device to seal the filled sack; and a control device that (i) is connected to measuring instruments that transfer to the control device information used to determine a filling level of the sack, (ii) regulates the distance between the product discharge opening and the filling level of the sack based on material- and filling-specific target values that minimize mist formation in the product, and (iii) measures a weight of the filled sack to confirm that a desired quantity of the product is fed into the sack, and, if necessary, corrects the quantity that is fed, the discharge opening of the feed element being located below the fill level of the product in the sack during the filling of the sack.

20. The machine according to claim 19, wherein the control device guides the sack lifting device as a function of time such that the sack lifting device lowers the sack as the sack is filled.

* * * * *